US006805765B1

(12) United States Patent
Brandli et al.

(10) Patent No.: US 6,805,765 B1
(45) Date of Patent: Oct. 19, 2004

(54) METHOD AND APPARATUS FOR THE PREPARATION OF A PAPER REEL FOR FLYING REEL CHANGE

(75) Inventors: Walter Brandli, Laufen (CH); Oliver Colombo, Roschenz (CH); Romain Marchand, Pleigne (CH)

(73) Assignee: Metso Paper AG, Delemont (CH)

( * ) Notice: Subject to any disclaimer, the term of this patent is extended or adjusted under 35 U.S.C. 154(b) by 0 days.

(21) Appl. No.: 10/668,263

(22) Filed: Sep. 24, 2003

(30) Foreign Application Priority Data

Oct. 14, 2002 (EP) ..... 02022893

(51) Int. Cl.[7] ..... B65H 19/18; B32B 31/00

(52) U.S. Cl. ..... 156/187; 156/159; 156/256; 156/504; 156/517; 242/555.3

(58) Field of Search ..... 156/159, 187, 156/256, 502, 504, 517; 242/551, 553, 555.3, 555.4, 556.1; 428/41.7, 41.8, 57, 343

(56) References Cited

U.S. PATENT DOCUMENTS

| | | | | |
|---|---|---|---|---|
| 4,597,820 A | * | 7/1986 | Nozaka | 156/353 |
| 5,277,731 A | * | 1/1994 | Krimsky et al. | 156/159 |
| 5,318,656 A | * | 6/1994 | Dylla et al. | 156/357 |
| 5,322,230 A | | 6/1994 | Dylla et al. | |
| 5,330,125 A | * | 7/1994 | Dylla | 242/562 |
| 5,524,844 A | | 6/1996 | McCormick et al. | |
| 6,264,132 B1 | * | 7/2001 | Menz et al. | 242/555.2 |
| 2003/0116256 A1 | * | 6/2003 | Erickson | 156/157 |

FOREIGN PATENT DOCUMENTS

| | | |
|---|---|---|
| DE | 42 33 521 A1 | 4/1994 |
| EP | 1 041 025 A2 | 10/2000 |
| WO | WO 02/102694 A1 | 12/2002 |

* cited by examiner

*Primary Examiner*—Mark A. Osele
(74) *Attorney, Agent, or Firm*—Oliff & Berridge, PLC

(57) ABSTRACT

A roll (22) is rotatably mounted in a slide (17) which is mounted so as to be perpendicularly displaceable in a carriage (11) which can be moved above a paper reel (8) transversely to its axis. The carriage (11) can be moved in a raisable and lowerable boom (4). The carriage also carries a transverse slide which can be moved along the axis and has a cutting device and an adhesive bonding device. The roll (22) is placed with a cutting bar on the uppermost generating line of the paper reel (8) and rolled thereon and the uppermost layer of the paper reel (8) held by suction and lifted off by rolling the roll (22) in the opposite direction beyond the starting position. After an end section has been cut off along the cutting bar by means of the cutting device and an adhesive tape has been applied to the paper reel in the region of the uppermost generating line, the roll (22) is rolled back to the starting position and that section of the paper web which is adjacent to the edge of the web end is pressed onto a part of the outer surface of the adhesive tape.

20 Claims, 14 Drawing Sheets

METHOD AND APPARATUS FOR THE PREPARATION OF A PAPER REEL FOR FLYING REEL CHANGE

FIELD OF THE INVENTION

The invention relates to a method for the preparation of a paper reel for flying reel change according to the precharacterizing clause of claim 1 and an apparatus for carrying out the method according to the precharacterizing clause of claim 7. Such methods and apparatuses are used in reel cellars of printing works.

PRIOR ART

It is known that paper reels can be prepared for flying reel change by using an adhesive tape which joins the edge of the web end to the next inner layer and at the same time has, on the outer surface of the paper reel, an adhesive surface, for adhesive bonding to the residual reel, cf. for example DE-A-43 39 309. Recently, such adhesive tapes have also become available (cf. for example so-called Flying Splice System 551 from ASS-Etikett GmbH, Flying Splice Print Line tesa 51100 from Tesa AG or DE-A-196 32 689), which consist of an outer tape and an inner tape which are arranged one on top of the other and are connected in a separable manner. The inner tape is provided with an inner adhesive surface for joining to the next inner layer whereas the outer tape has an outer adhesive surface for joining to the web end and the residual roll.

For mounting conventional tapes, methods have been proposed in which a web section is unwound from the paper reel, the adhesive tape is mounted on the edge of the web end on the outside of the paper web and the latter is then rolled up again and the edge of the web end is joined to the next lower layer by means of projecting adhesive labels simultaneously mounted there, and corresponding apparatuses (cf. DE-C-195 40 689). However, they cannot be directly adopted since the adhesive tape is mounted there on the outside of the paper web, which is not possible in the case of adhesive tapes of the novel type. This also applies to similar cases where the joining of the edge of the web end to the next lower layer is performed by means of a separate so-called butterfly, while, for producing the joint with the paper web of the residual reel, a double-sided adhesive tape is mounted on the outside of the paper web, just before the edge of the web end (DE-C-39 18 552).

DE-A-38 34 334 discloses a method of the generic type and a corresponding apparatus, which is suitable for the use of adhesive tapes of the novel type described above. After a web section has been unwound so that a part thereof hangs over an oblique support surface mounted below the reel, an edge of the web end is produced by cutting off an end section along a cutting line running over the support surface, and the adhesive tape is then pressed there onto the inside of the outermost layer and the web is rolled up again. In this procedure, the position of the unrolled web section is not constantly under control, so that slight lateral shifts or waves form and may interfere with the procedure and cause web winding errors. Moreover, the paper reel must be rotated, i.e. must be rotatably mounted, which considerably increases the complexity of the apparatus.

A method which is similar in the basic principles and the corresponding apparatus, which are described in EP-A-1 041 025, ensure the control of the unrolled web section by a procedure in which the inside thereof is first held in an adhesion area by means of suction orifices and the end section is cut off for the preparation of the edge of the web end and then the outside is held by a second adhesion area while the adhesive tape is pressed onto the inside along the edge of the web end. However, this requires a considerably complicated design, especially since here too the reel has to be rotatably mounted.

SUMMARY OF THE INVENTION

It is the object of the invention to provide a method in which the position of the paper web is always under control. Moreover, it should be capable of being carried out with little effort. This object is achieved by the features in the characterizing clause of claim 1. The invention provides a method in which the unrolled web section, which is subsequently placed again on the reel, never hangs freely but is always under tension. Thus, the position of the replaced web section is exactly defined and free of errors. In addition, rotation of the reel is not required. It therefore need not be clamped.

It is a further object of the invention to provide a suitable apparatus for carrying out the method according to the invention. This object is achieved by the features in the characterizing clause of claim 7. The apparatus according to the invention enables the method to be carried out reliably and cleanly. It can moreover be produced relatively simply and with moderate effort.

BRIEF DESCRIPTION OF THE DRAWINGS

The invention is explained in more detail below with reference to figures which show only one embodiment.

DESCRIPTION OF THE PREFERRED EMBODIMENTS

Figure 1:
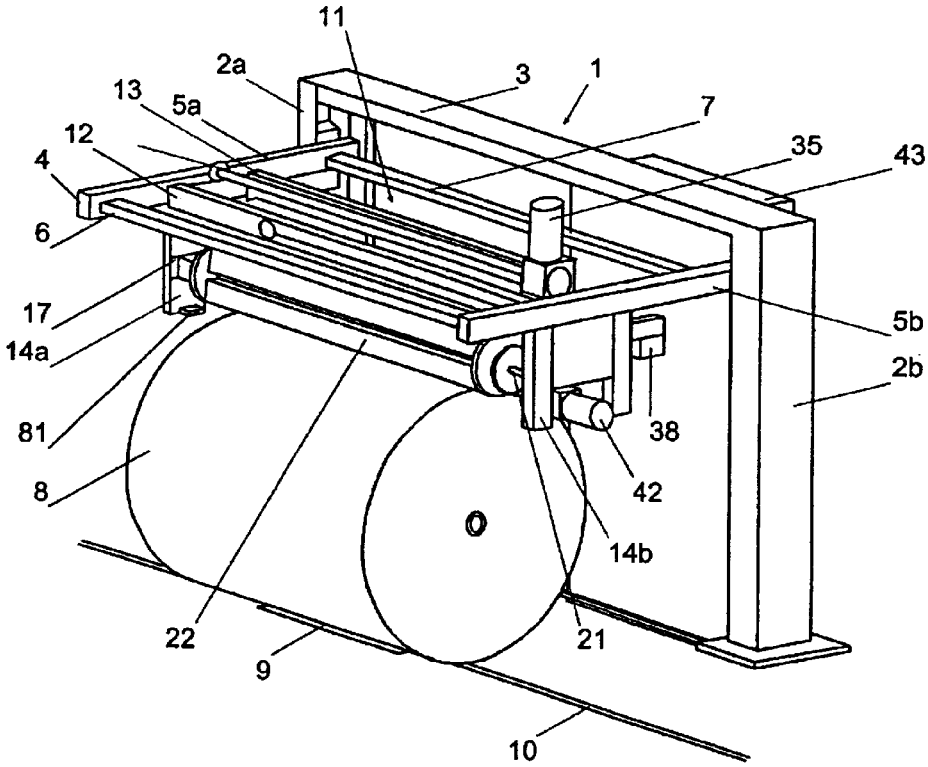
FIG. 1 schematically shows a perspective view of an apparatus according to the invention for carrying out the method according to the invention, with a paper reel, FIG. 2 schematically shows a front view of the apparatus according to FIG. 1, FIG. 3 schematically shows a side view of the apparatus according to FIG. 1, FIG. 4 schematically shows a side view corresponding to FIG. 3, certain parts having been omitted.
Figure 2:
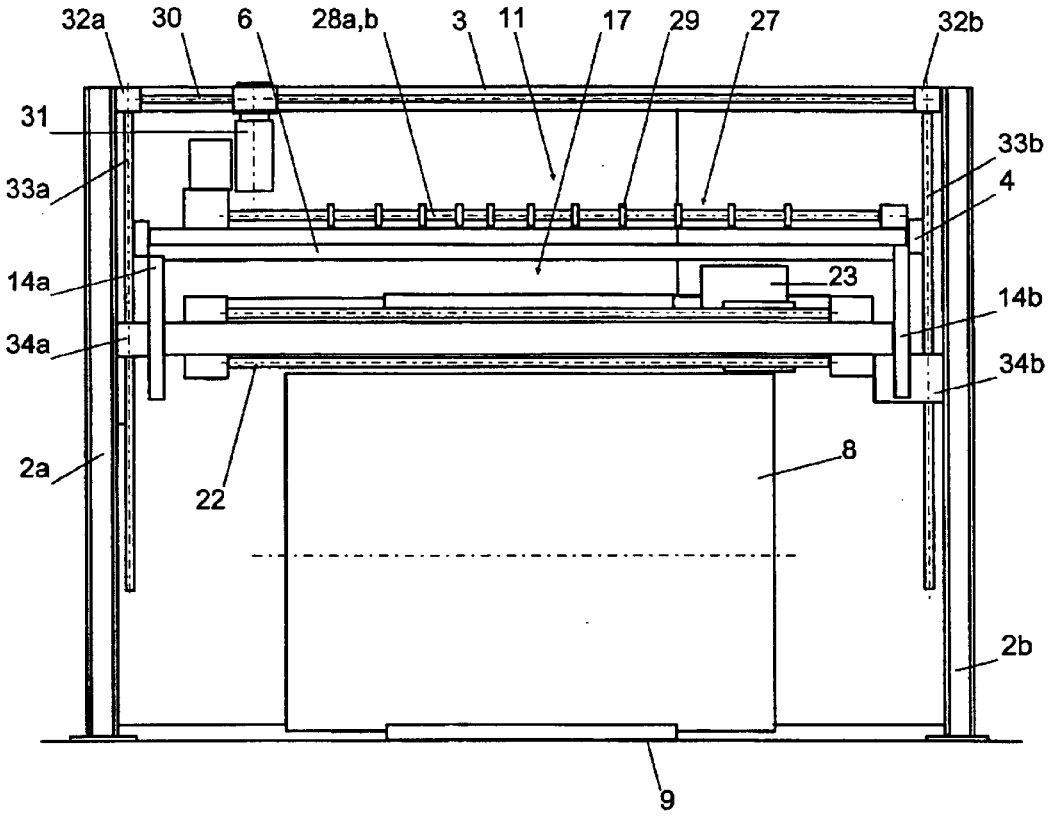
Figure 3:
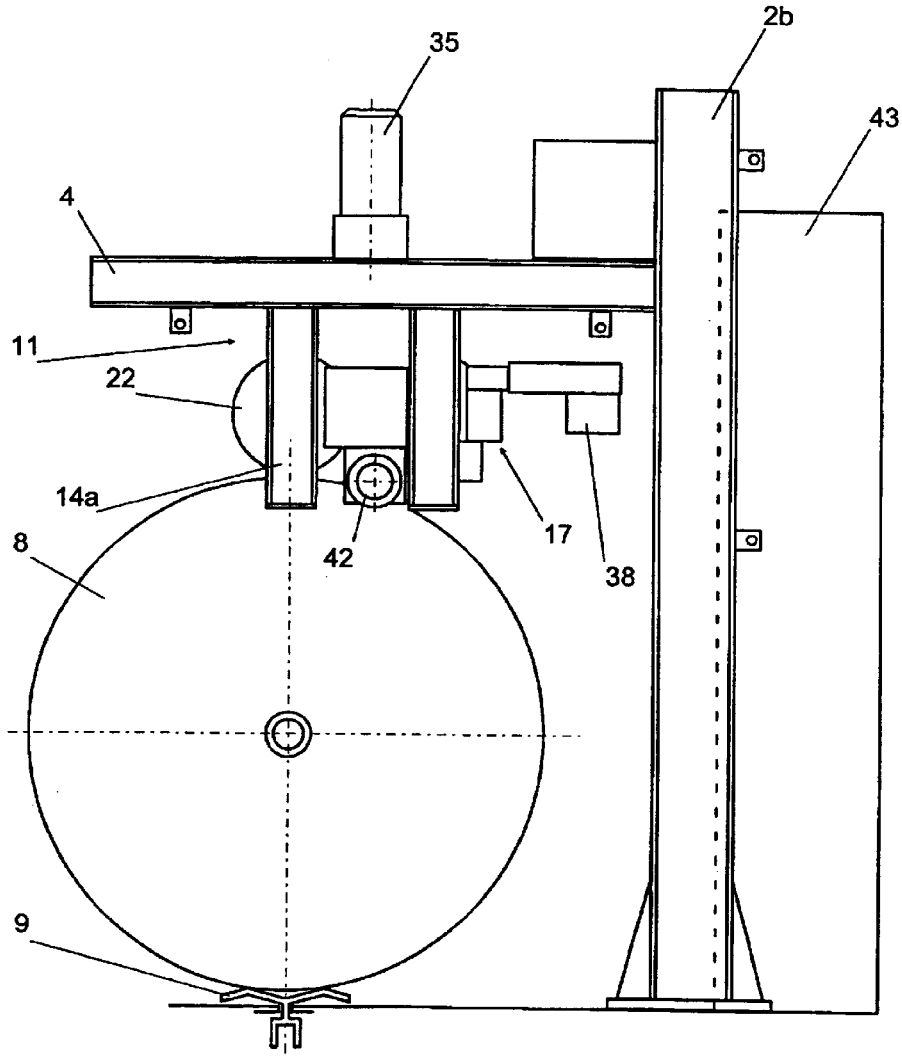
Figure 4:
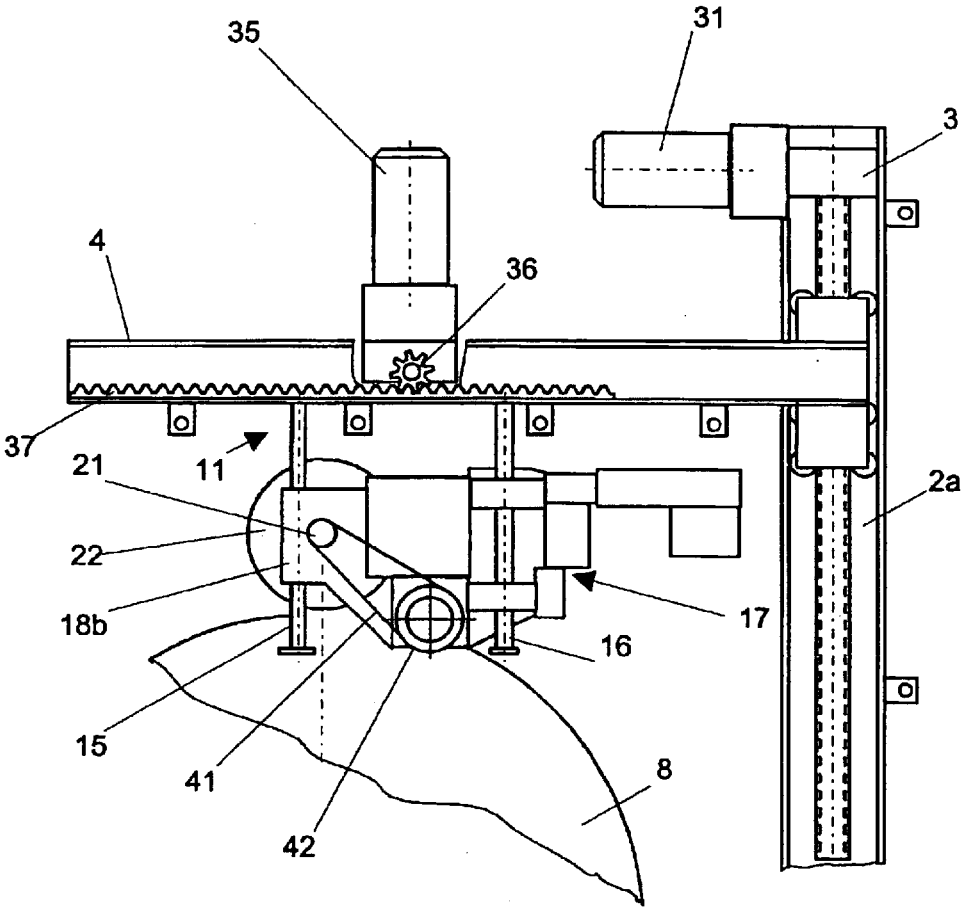
Figure 5:
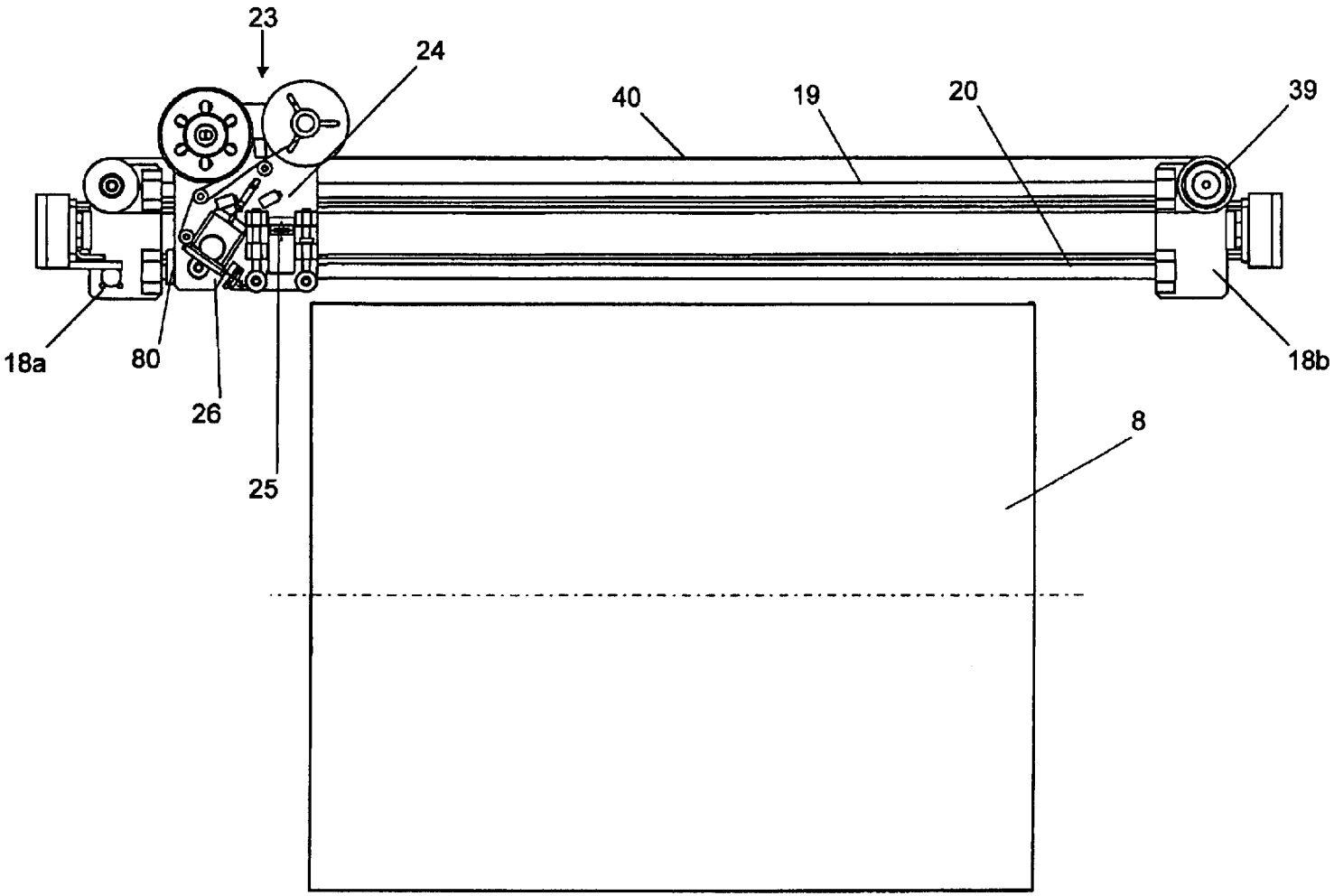
FIG. 5 shows a front view of a component of the apparatus according to FIG. 1.

The apparatus according to the invention has (FIG. 1) a stand 1 comprising two perpendicular columns 2*a,b* which are connected by a tie-beam 3. A frame-like boom 4 having two side beams 5*a,b* and two crossbeams 6, 7 is mounted so as to be perpendicularly displaceable on the columns 2*a,b*, said boom projecting forwards over a paper reel 8 whose axis is parallel to the tie-beam 3 and which rests on a transport carriage 9. The transport carriage 9 is displaceable or drivable along a sunk rail 10 running past the apparatus.

On the boom 4 is a carriage 11 comprising a horizontal frame having two tie-beams 12, 13 and downward-projecting side parts 14*a,b* mounted so as to be longitudinally displaceable, i.e. displaceable transversely to the tie-beam 3. In each case guides 15, 16 (cf. also FIG. 4, where some of the side parts 14*a,b* have been omitted) on which a slide 17 is mounted so as to be perpendicularly displaceable are provided on the insides of the side parts 14*a,b*. Said slide has lateral frame parts 18*a,b* which are connected by guide rods 19, 20 (FIG. 5) parallel to the tie-beams 12, 13 and arranged perpendicularly one on top of the other. Before the guide rods 19, 20, bearings for rotatable mounting of the ends of an axle 21 which is parallel to the guide rod and carries a coaxial roll 22 are mounted in the frame parts 18*a,b* (FIG. 1-4, not shown in FIG. 5).

A transverse slide 23 is displaceably mounted on the guide rods 19, 20 (FIG. 5) in such a way that it can be moved between the frame parts 18*a,b*. A cutting device 25 and an adhesive bonding device 26 are mounted on a support plate 24 of said transverse slide. Above the transverse slide 23, a take-off device 27 (FIG. 2) is anchored on the slide 17 so as to be tiltable by means of a pneumatic cylinder and has two shafts 28*a,b* which are parallel to the tie-beams and over which a plurality of parallel elastic belts 29 run over the length of said shafts, and one of which shafts is drivable. For reducing the effective weight of the slide 17, the latter can be supported by means of gas springs on the carriage 11.

The perpendicular displacement of the boom 4 is effected (FIG. 2) by means of a shaft 30 which is mounted in the tie-beam 3 and can be driven by a motor 31 and, via angular gears 32*a,b*, drives lifting spindles 33*a,b* which are mounted on the columns 2*a,b* and engage corresponding threaded bushes 34*a,b* on the boom 4. The movement of the carriage 11 is (cf. FIG. 4) produced by a motor 35 which is fastened to said carriage and drives pinions 36 which engage toothed racks 37 fastened to the side beams 5*a* and 5*b* of the boom 4.

The movement of the transverse slide 23 along the guide rods 19, 20 is produced by a further motor 38 (FIG. 3), in particular via a pinion 39 (FIG. 5), over which a closed toothed belt 40 runs, whose lower side is connected to the transverse slide 23. The roll 22 can (FIG. 4) be driven via a toothed belt 41 by a motor 42 fastened to the slide 17. The positions of the boom 4, of the carriage 11, of the transverse slide 23 and of the bracket of the roll 22 are each monitored by corresponding transducers and transmitted to a control unit in a switch box 43 fastened to the frame 1 (shown only in FIG. 1).

Figure 6:
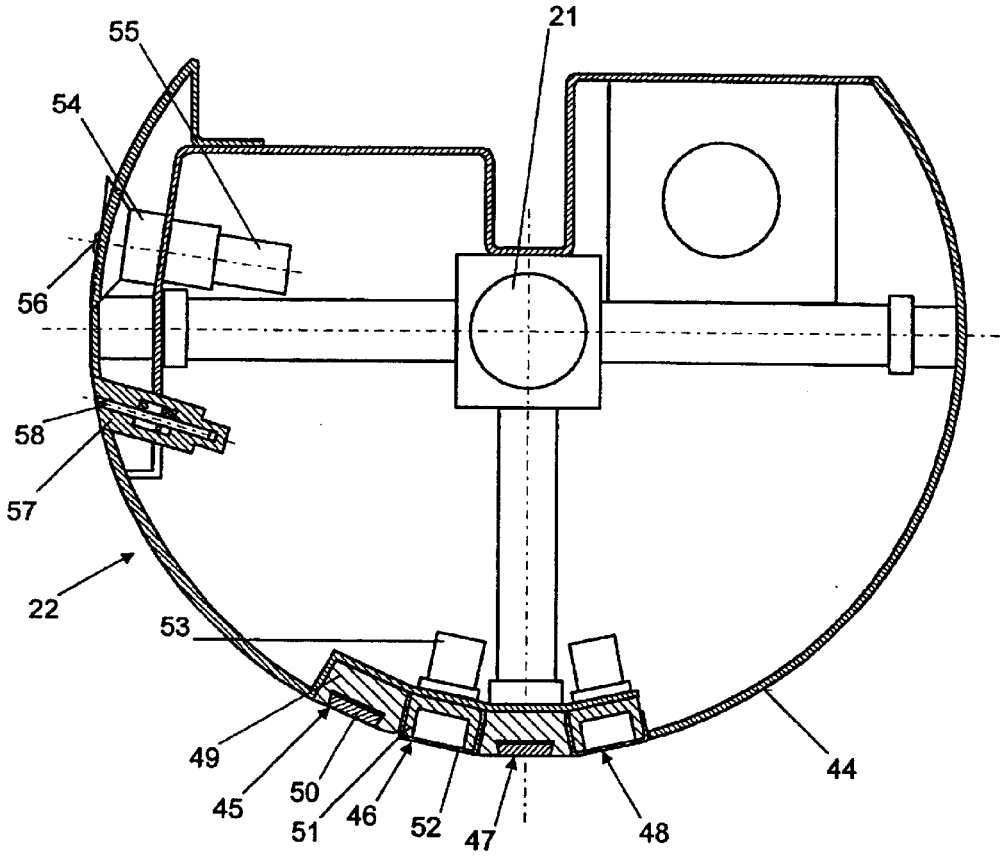
FIG. 6 shows a cross-section through another component of the apparatus according to FIG. 1.

The roll 22 has (FIG. 6) a lateral surface 44 which has the shape of a cylindrical sector which is coaxial with the axle 21 and extends over its entire length and about two thirds of the full angle. Its outside forms a support surface in which a first cutting bar 45, a first suction bar 46, a second cutting bar 47 and a second suction bar 48 are sunk. Said bars each extend along a generating line over the entire length of the roll 22 and follow one another directly azimuthally. The cutting bars 45, 47 are each in the form of a profile which has, on the outside, a shallow groove in which a cutting bar 50, preferably comprising a plastic having low adhesion and friction values or comprising metal, possibly coated with a plastic of the type described, is sunk. The suction bars 46, 48 are each in the form of a profile 51 having an outward-facing groove which is divided into a plurality of chambers and is covered by a strip 52 of perforated sheet metal, the outside of which forms a suction zone. From the inside, at least one suction line 53 opens into the groove, via which air can be drawn through a pump, which is not shown, and reduced pressure can be generated.

A row of suction cups 54, each of which are connected to the pump via suction lines 55 and likewise for generating reduced pressure, are arranged on the front of the roll 22, azimuthally about 75° away from the first cutting bar 45, along a generating line. Each of the suction cups 54 has a valve which can be operated by means of a tappet 56 and is open only when said tappet is slightly pushed back by contact with an object. A row of needles 58 which are sunk but mounted in pneumatic cylinders 57 so as to be displaceable over the support surface is arranged shortly before the row of suction cups 54. Said needles are inclined slightly towards the row of suction cups 54.

Figure 7:
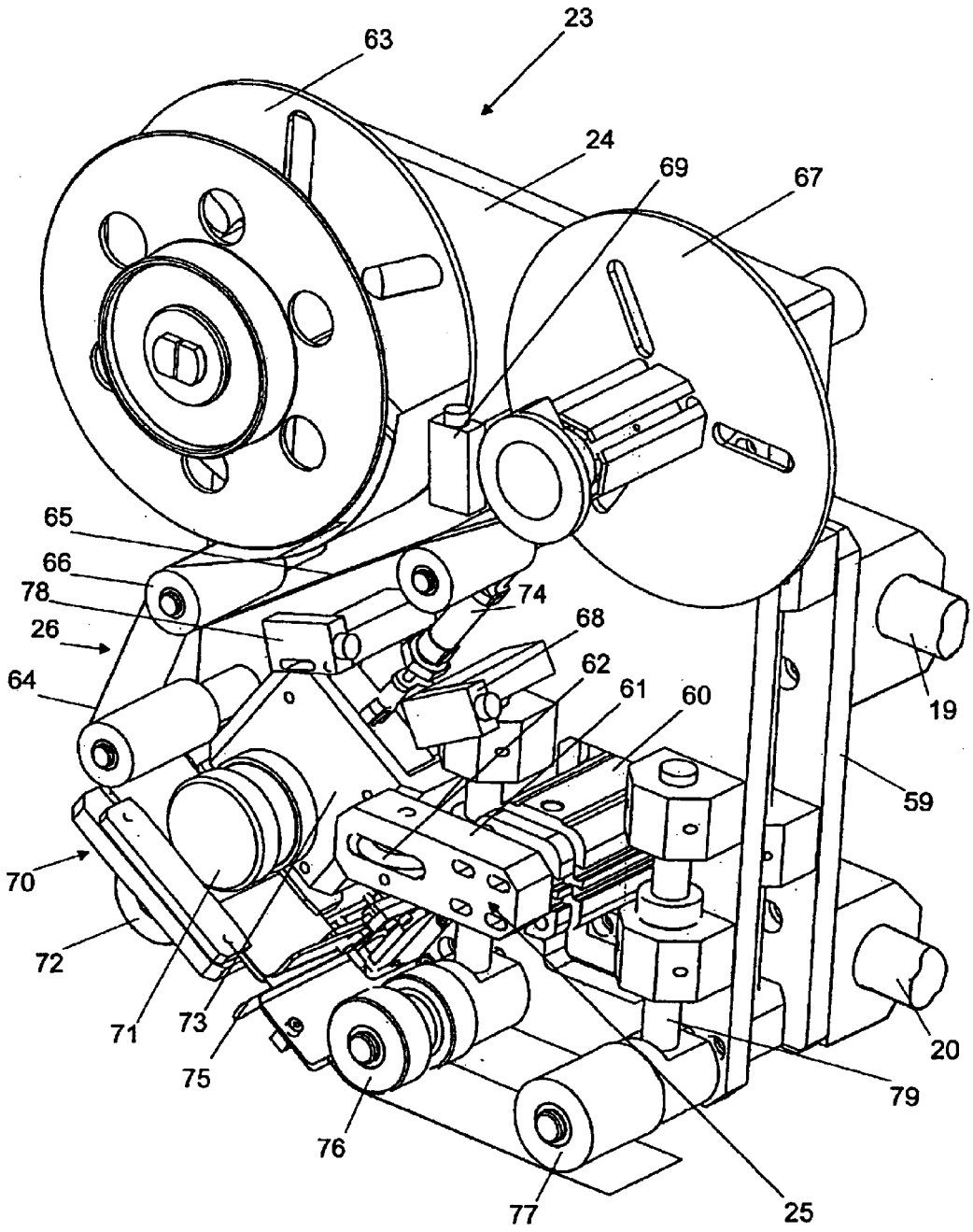
FIG. 7 shows a perspective view of a part of the component of FIG. 5 and FIG. 8*a-l* schematically show the sequence of a method according to the invention.

The transverse slide 23 has (FIG. 7) a baseplate 59 which is displaceably mounted directly on the guide rods 19, 20 and on which the support plate 24 is suspended in such a way that it is vertically displaceable to a limited extent. Its vertical position can be adjusted by a pneumatic cylinder.

The cutting device 25 projects from the baseplate 59 of the transverse slide 23 through a slot in the support plate 24 towards the roll 22. Said device comprises a pneumatic cylinder 60 which carries a housing 61 in which a cutting disc 62 is rotatably mounted. The housing 61 can be advanced towards the roll 22 by means of the pneumatic cylinder 60 until the cutting disc 62, which is exactly at the height of the roll axis, just touches the first cutting bar 45 or the second cutting bar 47, depending on the angular position of the roll 22.

The adhesive bonding device 26 consists of a plurality of parts which are fastened or mounted on that side of the support plate 24 of the transverse slide 23 which faces the roll 22. A rotatably mounted, lightly braked storage roll 63 carries an adhesive tape 64 which is covered by a top tape 65 which is taken off completely or partly at a deflection roller 66 and is rolled onto a winding roller 67 driven with a slip. This is monitored by an optical tape sensor 68. The tape stock on the storage roller 63 is monitored by a likewise optical stock sensor 69. The adhesive tape 64 runs on through a guide 70, where it is clamped between a drive roller 71 and an idling counter roller 72 of a feed device. The drive roller 71 is mounted in a holder 73 which is pressed by a pneumatic cylinder 74 against the counter roller 72. For manually drawing in a new adhesive tape, the holder 73 is drawn back by the pneumatic cylinder 74.

The adhesive tape 64 continues through scissors 75 and under a first pressure roller 76 and a second pressure roller 77 which follows said first pressure roller and is pressed against the roller 8. A feed sensor 78 monitors whether the adhesive tape 64 has been advanced at least up to just before the first pressure roller 76. The pressure rollers 76, 77 are suspended at the same height in the same manner from the support plate 24, in each case from a bearing at the lower end of a perpendicularly displaceable ram 79 which is pressed by a pressure spring (not shown) downwards against the paper reel 8.

An optical length sensor 80 (FIG. 5) which responds as soon as it is present above the paper reel 8 is arranged on the left of the support plate 24. Similarly, a likewise optical diameter sensor 81 (FIG. 1) which detects the edge of the end face of the paper reel 8 when the boom 4 is lowered is arranged laterally on the side part 14*a* of the carriage 11. The signals of all sensors are fed to the control unit in the switch box 43.

Figure 8A:
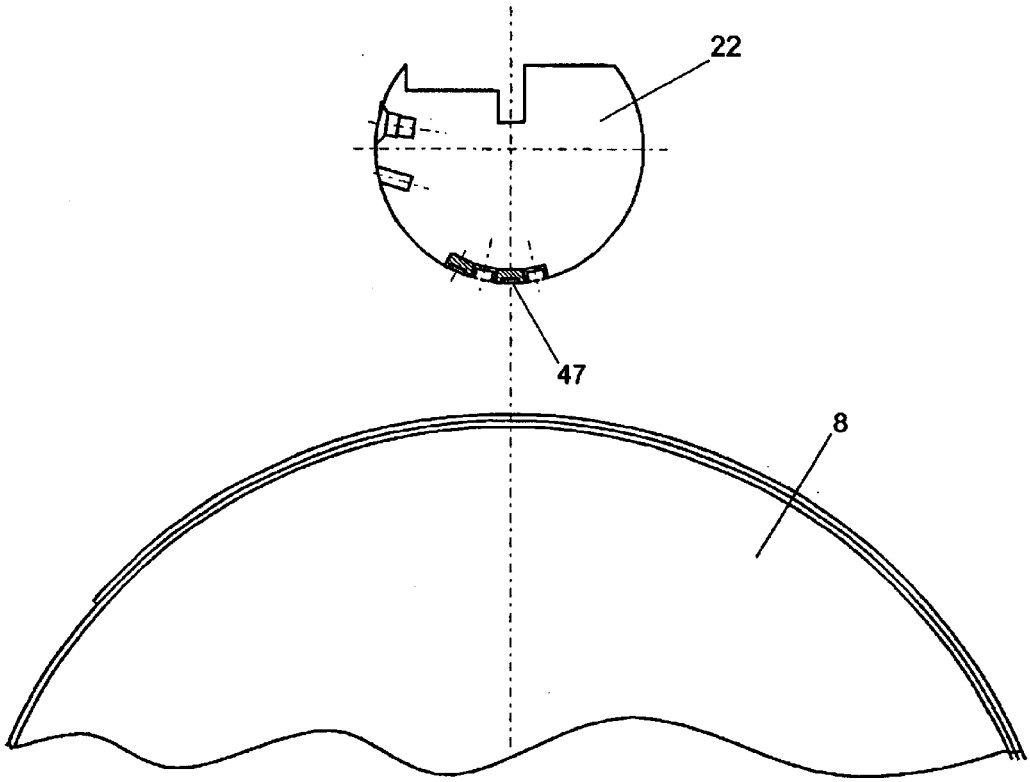

The Preparation of a Paper Reel Takes Place as Follows:

The paper reel 8 is moved on the transport carriage 9 below the boom 4. The end of the paper web is on the side facing the stand 1. The paper web goes so far beyond the uppermost generating line of the paper reel 8 that the outermost layer does not slide back under its own weight. The carriage 11 is moved to a starting position in which the axle 21 of the roll 22 is exactly above the middle of the rail 10 and hence the uppermost generating line of the paper reel 8. The roll 22 is then rotated by the motor 42 into a zero position in which a cutting line coinciding with the central line of the second cutting bar 47 is at the bottom, i.e. is exactly opposite the uppermost generating line of the paper reel 8 (FIG. 8*a*).

Figure 8B:
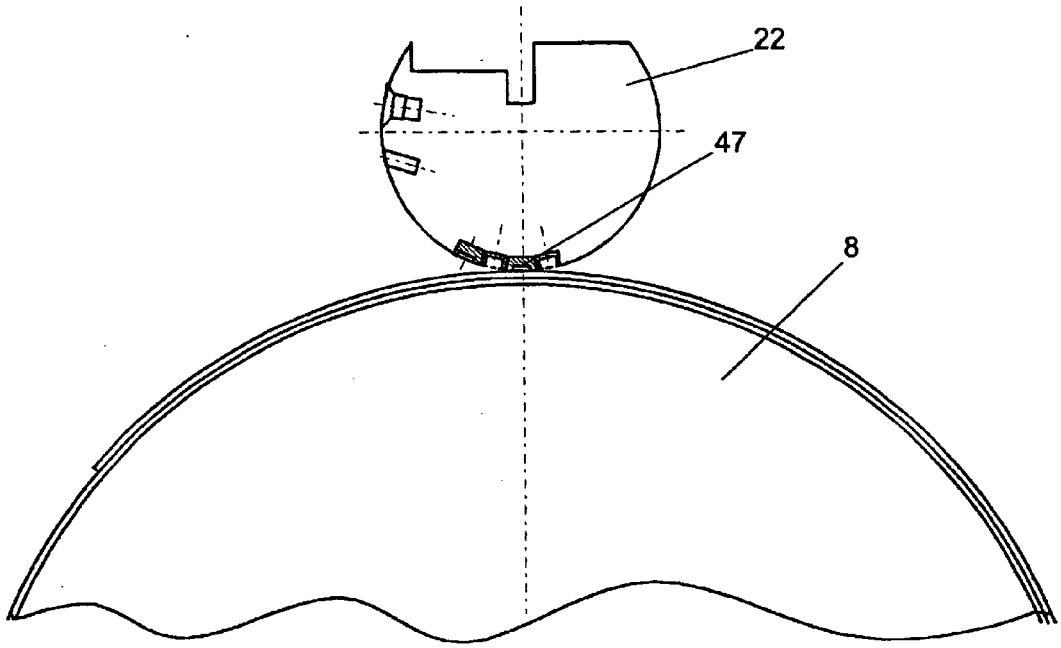

The boom 4 is now lowered by means of the motor 31 until either the diameter sensor 80 responds or the boom 4 has reached a certain height without said sensor having responded. In the last-mentioned case, in which the paper reel 8 has a diameter which is smaller than a certain limit (small reel) is discussed further below. In the first-mentioned case, in which the diameter of the paper reel 8 is larger than the limit (large reel), the boom 4 is further lowered at a reduced speed by a fixed distance after the diameter sensor 80 has responded, and the roll 22 is placed on the paper reel 8 so that the central line of the second cutting bar 47 touches the uppermost generating line. Since the boom 4 with the carriage 11 is lowered slightly further after the roll 22 has been placed on top, the slide 17 is pushed upwards out of its lower limiting position so that it acquires latitude in the downward direction in the carriage 11. Finally, the roll 22 is uncoupled from the motor 42 (FIG. 8*b*).

Figure 8C:
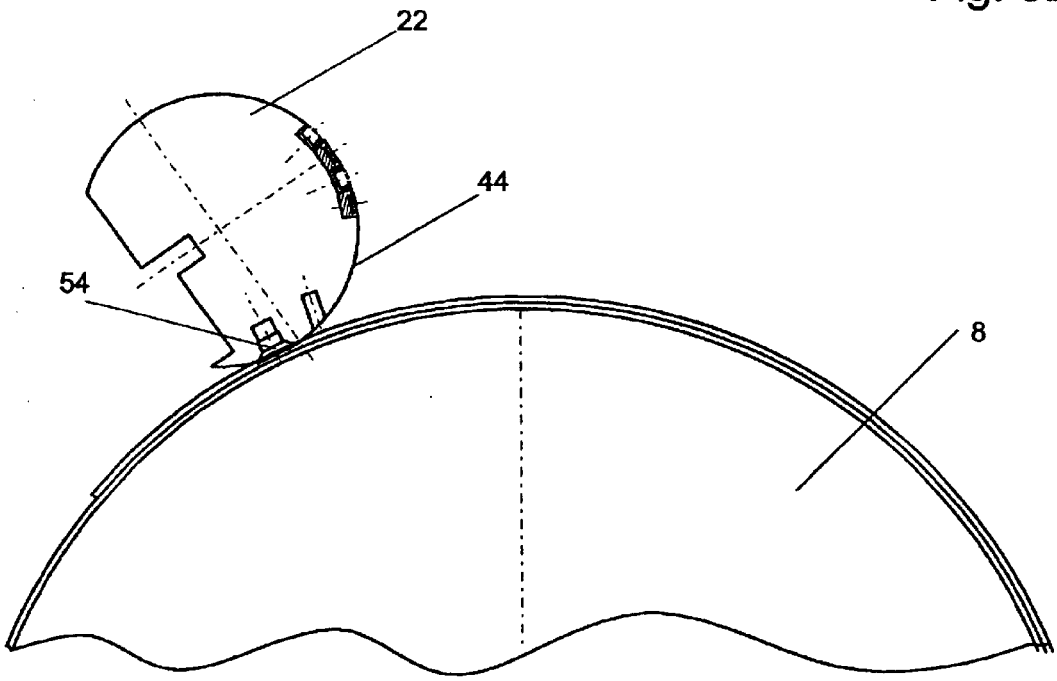

The carriage 11 now advances further, i.e. it moves towards the stand 1 along a horizontal feed direction. Since the roll 22 is freely rotatable, the lateral surface 44 thereof is rolled from its starting position shown in FIG. 8*b*, in the direction opposite to the unwinding direction of the paper reel 8, on said paper reel until the suction cups 54 come into contact with the paper reel 8. The slide 17 moves slightly downwards. The carriage 11 is stopped when the roll 22 has reached an angular position calculated beforehand by the control unit from the known diameter of said roll and the determined diameter of the paper reel 8. Reduced pressure is now applied to the suction cups 54, provided that their valves are opened by contact of the tappets 56 with the paper reel 8, and the outermost layer of the paper web is held by suction (FIG. 8*c*).

Figure 8D:
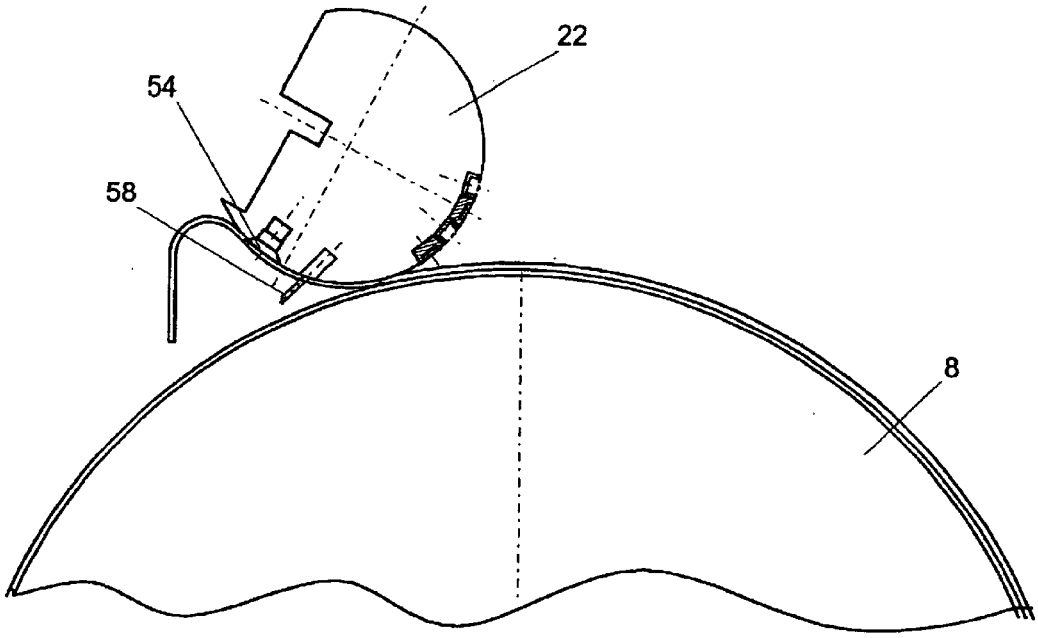
Figure 8E:
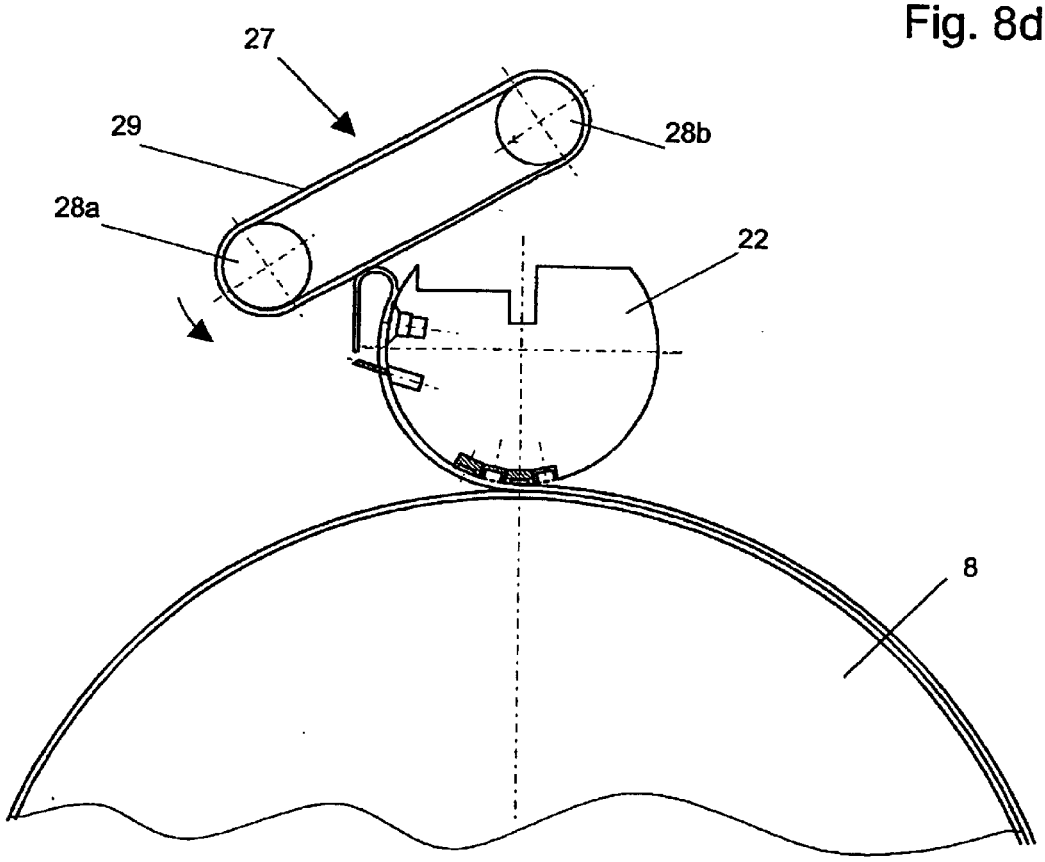

Subsequently, the carriage 11 is moved beyond its starting position away from the stand 1, the lateral surface 44 now being rolled on the paper reel 8 in the unwinding direction of the paper web. After a short travel distance, nails 58 are extended and pierce the outermost layer of the paper web and thus reliably hold the latter on the lateral surface 44 (FIG. 8*d*). That part of the paper web which projects beyond the row of suction cups 54 is drawn, by tilting of the take-off device 27 towards the the roll 22 and movement of the belt 29 in the direction of the arrow, between said belt and the roll 22 (FIG. 8*e*).

Figure 8F:
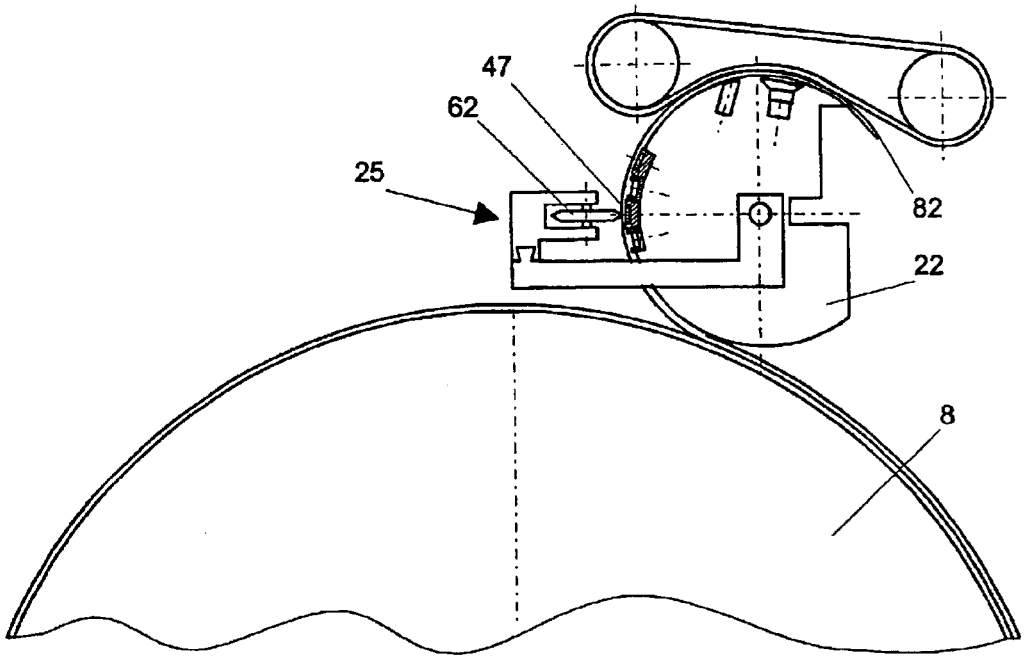

During the further rolling movement, the first suction bar 46 and the second suction bar 48 are also switched on when the roll 22 has reached those precalculated angular positions in which they come into contact with the outermost layer of the paper reel 8. The carriage is stopped when the second cutting bar 47 points towards the transverse slide 23, i.e. after rotation of the roll through exactly 90° relative to its starting position. For cutting off an end section and producing an edge of the web end, the paper web is then cut by means of the cutting device 25. For this purpose, the housing 61 is advanced by means of the pneumatic cylinder 60 until the edge of the cutting disc 62 just reaches the second cutting bar 47 at the cutting line. The transverse slide 23 is in a base position on the right of the carriage 11. The transverse slide 23 is now moved to the left side and an edge of the web end is produced by cutting off an end section 82 of the paper web (FIG. 8*f*).

During the same movement or after the transverse slide 23 has returned to the base position, the adhesive tape 64 is applied to the next inner layer of the paper web in the region of the uppermost generating line by means of the adhesive bonding device 26, while a section of the outermost layer which is adjacent to the edge of the web end is held against the lateral surface 44 by the second suction bar 48. For this purpose, the adhesive tape 64 is (also see FIG. 7) advanced by means of the feed device until the feed sensor 78 detects that it has reached the first pressure roller 76 and the transverse slide 23 is moved to the left from the base position with raised support plate 24, the length sensor 80 detecting the beginning of the reel until the first pressure roller 76 is above a point which is a certain distance—usually a few millimeters—away from the beginning of the reel.

Figure 8G:
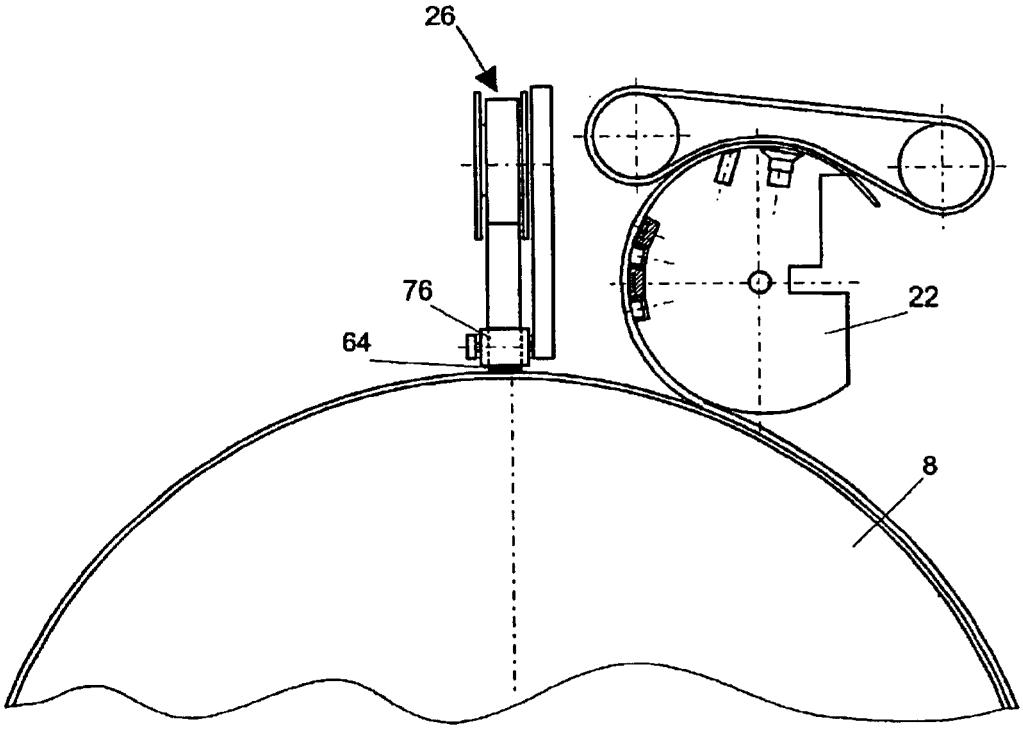

The support plate 24 is then lowered so that the pressure roller 76 rests on the paper reel 8 and is pressed upwards against the force of the pressure spring. The movement is terminated when the force has reached a certain value, which can be determined, for example, by monitoring the deflection of the ram of the pressure roller 76 by means of a further optical sensor. The adhesive tape 64 is pressed against the paper reel 8 by the pressure roller 76 (FIG. 8*g*) so that the underside of the inner tape adhesively bonds thereto. Shortly after the length sensor 80 has detected the end of the paper reel 8, the transverse slide 23 is stopped and the adhesive tape 64 is cut by means of the scissors 75. The transverse slide 23 then continues its movement until the remainder of the cut-off adhesive tape 64 has been pressed onto the paper reel 8 by the pressure rollers 76, 77. Finally, the support plate 24 is raised again and the transverse line 23 is moved back to the starting position.

Figure 8H:
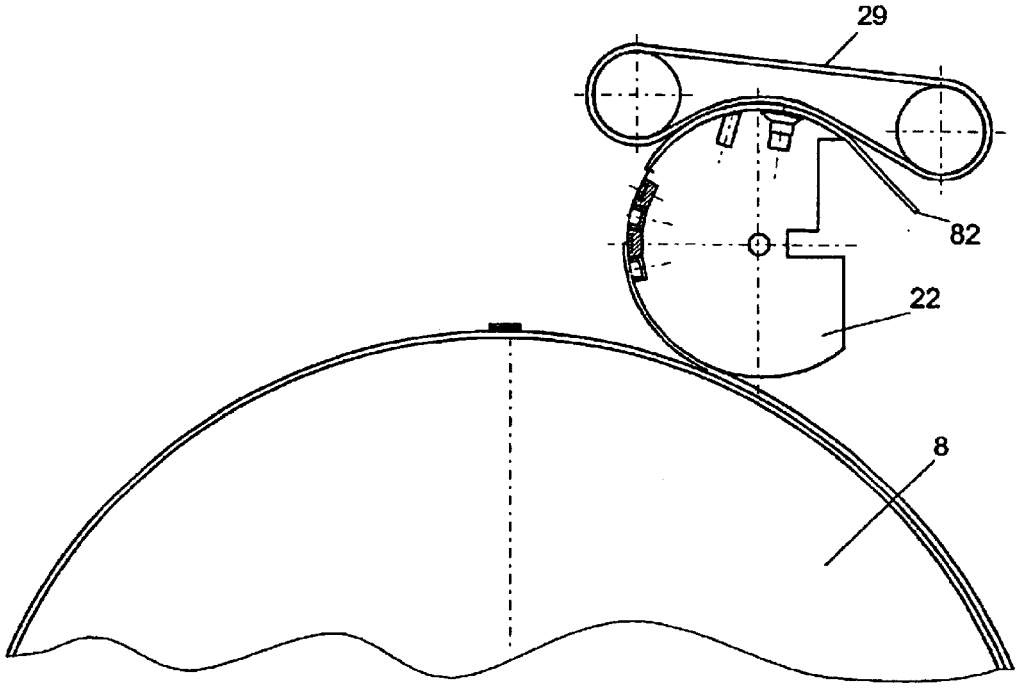

The cut-off end section 82 of the paper web is now drawn over the roll 22 by corresponding movement of the belt 29 (FIG. 8*h*) and is removed via a subsequent chute, which is not shown. Finally, the carriage 11 is advanced again to its starting position and the lateral surface 44 is rolled back on the paper reel 8 exactly to its starting position in which the cutting line coincides with the uppermost generating line of the paper reel 8, the second suction bar 48 being switched off as soon as it begins to be released from the paper web.

Figure 8I:
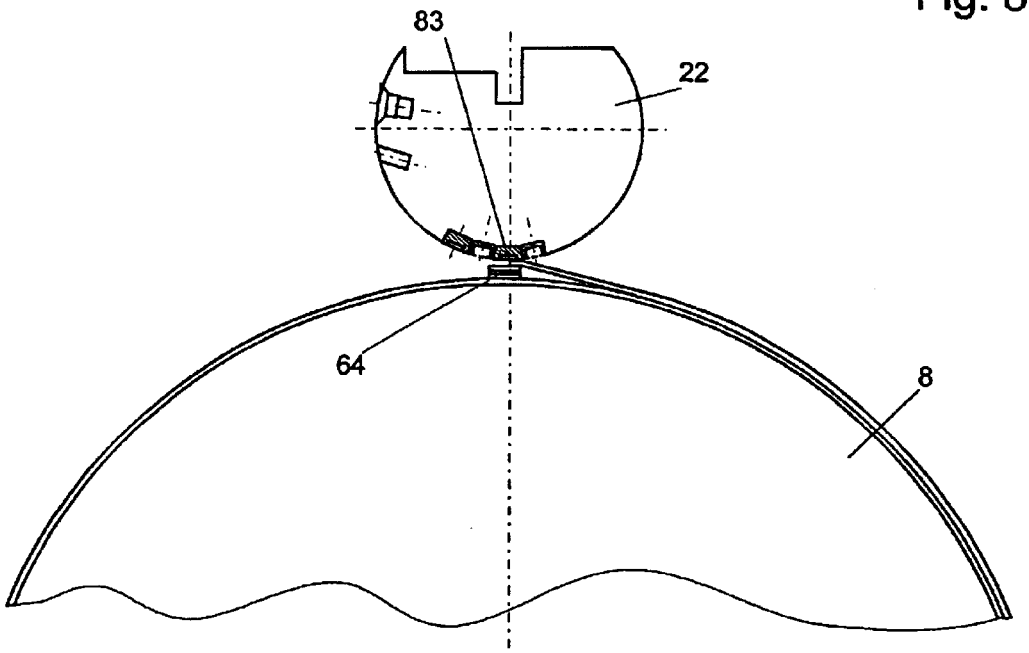

Consequently, a strip of the outermost layer of the paper reel 8 which is adjacent to the edge 83 of the web end is pressed onto an adhesive strip on the top of the outer tape of the adhesive tape 64, which adhesive strip is located behind the uppermost generating line, and thus adhesively bonded to the next inner layer, while an edge strip located before the uppermost generating line remains free and is subsequently available for adhesive bonding with the residual reel (FIG. 8*i*). During the application of the adhesive tape 64, only that part-strip of the top tape 65 which covers the adhesive strip of the outer tape can be removed so that the edge strip remains covered by the complementary part-strip, or the entire top tape 65 can be removed so that the edge strip is free and the adhesion point is "crisp". In the former case, the remaining part-strip of the top tape must be removed manually before the paper reel 8 is used in the reel stand.

Figure 8J:
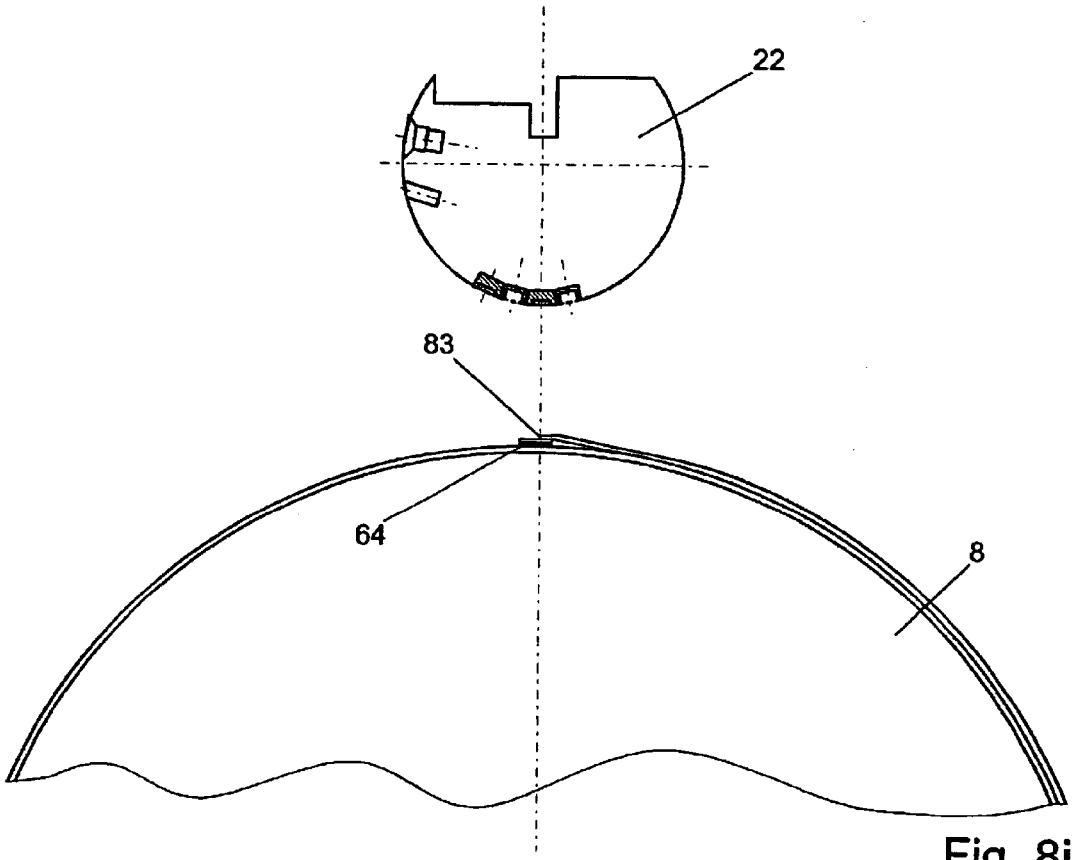

Finally, the boom 4 is raised and the roll 22 is lifted off the paper reel 8 and the adhesive tape 64. The preparation of the paper reel 8 is thus complete (FIG. 8*j*).

If the paper reel is to be driven in a reel stand by means of belts, it is possible to provide gaps in the applied adhesive tape 64 by cutting the same at predetermined points of the travel distance of the transverse slide 23 and raising the support plate 24 with the adhesive bonding device 26 after pressing on of the cut-away remainder and thus moving said support plate over the section of the generating line which is to remain free, whereupon the adhesive tape is fed again by the feed device to below the first pressure roller 76 and the support plate 24 is lowered again.

Figure 8K:
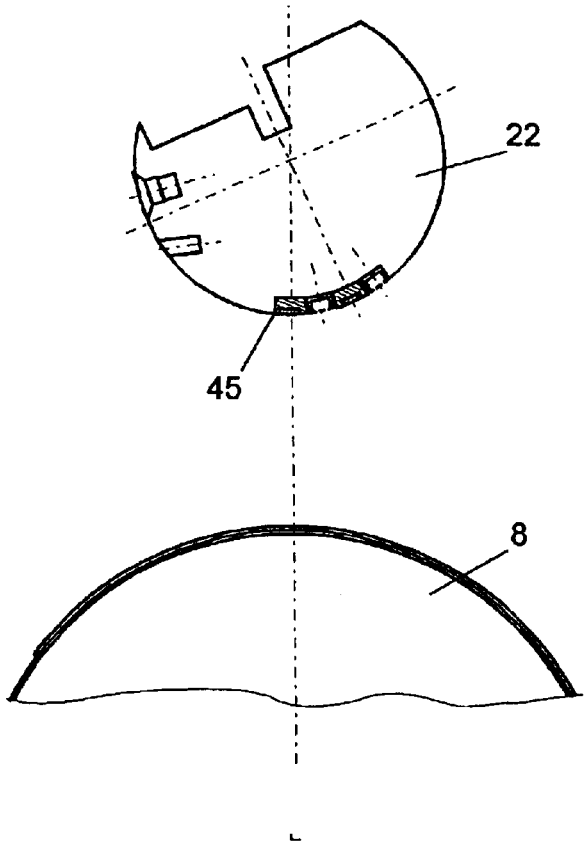
Figure 8L:
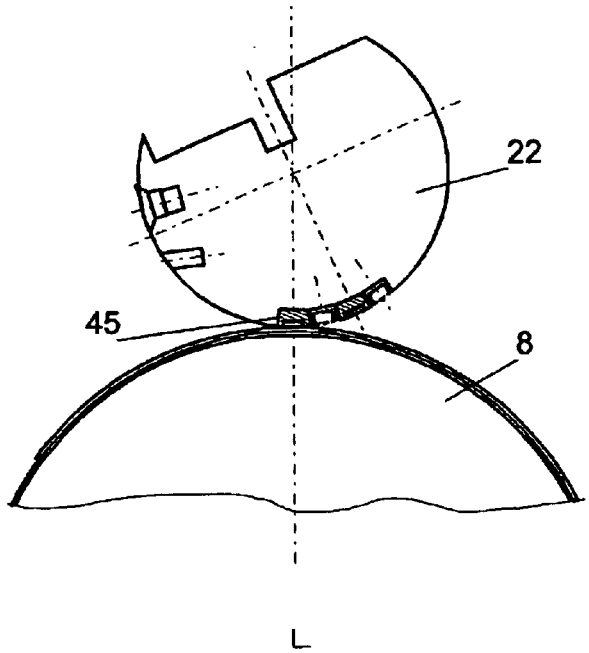

If the paper reel 8 is a small reel, i.e. if the boom 4 reaches a certain height on lowering without the diameter sensor 80 having responded, the roll 22 is rotated to a new starting position in which the first cutting bar 45 points downwards (FIG. 8*k*) and then lowered again initially rapidly and, after the diameter sensor 81 has responded, slowly until the first cutting bar 45 touches the uppermost generating line of the paper reel 8 (FIG. 8*l*). The further procedure takes place in the same manner as that described for large reels, except that the first cutting bar 45 takes the place of the second cutting bar 47.

List of Reference Symbols

1 Stand
2*a,b* Columns
3 Tie-beam
4 Boom
5*a,b* Side beams
6, 7 Crossbeams
8 Paper reel
9 Transport carriage
10 Rail
11 Carriage
12, 13 Tie-beams
14*a,b* Side parts
15, 16 Guides
17 Slide
18*a,b* Frame parts
19, 20 Guide rods
21 Axle
22 Roll
23 Transverse slide
24 Support plate
25 Cutting device
26 Adhesive bonding device
27, 28 Take-off device
29 Belt
30 Shaft
31 Motor
32*a,b* Angular gears
33*a,b* Lifting spindles
34*a,b* Threaded bushes
35 Motor
36 Pinion
37 Toothed rack
38 Motor
39 Pinion
40 Toothed belt
41 Toothed belt
42 Motor
43 Switch box
44 Lateral surface
45 First cutting bar
46 First suction bar
47 Second cutting bar
48 Second suction bar
49 Profile
50 Cutting strip
51 Profile
52 Strip
53 Suction line
54 Suction cup
55 Suction line
56 Tappet
57 Pneumatic cylinder
58 Needle
59 Baseplate
60 Pneumatic cylinder
61 Housing
62 Cutting disc
63 Storage roller
64 Adhesive tape
65 Top tape
66 Deflection roller
67 Winding roller
68 Tape sensor
69 Stock sensor
70 Guide
71 Drive roller
72 Counter roller
73 Holder
74 Pneumatic cylinder
75 Scissors
76 First pressure roller
77 Second pressure roller
78 Feed sensor
79 Ram
80 Length sensor
81 Diameter sensor
82 End section
83 Edge of web end

What is claimed is:

1. Method for the preparation of a paper reel (8) having a wound paper web for flying reel change by applying an adhesive tape (64) along an edge (83) of the web end, which has at least one outer tape having an outer adhesive surface for producing the joint between the web end and a paper web of a residual roll, and an inner tape which can be separated therefrom and has an inner adhesive surface for holding the web end on the next inner layer, by lifting of the outermost layer from the next inner layer, producing the edge (83) of the web end by cutting off an end section (82) from the outermost layer, applying the adhesive tape (64) and replacing the outermost layer on the next inner layer, a part of the outermost layer which is adjacent to the edge (83) of the web end being adhesively bonded to an adhesive strip of the outer adhesive surface while an edge strip adjacent thereto remains free and the inner adhesive surface adhesively bonds to the next inner layer, characterized in that, while the paper reel (8) remains otherwise unmoved, the lifting of the outermost layer is effected by placing a support surface, whose cross-section perpendicular to the axial direction of the paper reel (8) is substantially constant over its width, against the paper reel (8) and establishing a starting position in which a cutting line of the support surface, which cutting line is parallel to the axis of the paper reel (8), is in contact with a generating line of the paper reel (8), and the support surface is rolled, while the outermost layer is held resting on it, in the unwinding direction thereof on the paper reel (8), cutting off the end section (82) along the cutting line and applying the adhesive tape (64) to the next inner layer in such a way that the boundary between the adhesive strip and the edge strip coincides with the generating line, whereupon the support surface is rolled back to the starting position for replacement of the outermost layer.

2. Method according to claim 1, characterized in that the support surface is placed with the cutting line on the paper reel (8).

3. Method according to claim 1, characterized in that the axis of the paper reel (8) is kept horizontal and the support surface is placed on the uppermost generating line.

4. Method according to claim 1, characterized in that, before it is rolled in the unwinding direction, the support surface is first rolled a distance in the opposite direction on the paper reel (8) and the outermost layer is held on the support surface from the beginning of rolling in the unwinding direction.

5. Method according to claim 1, characterized in that the holding of the outermost layer on the support surface is effected by reduced pressure.

6. Method according to claim 1, characterized in that, after the end section (82) has been cut off, said end section is removed.

7. Apparatus for carrying out the method according to claim 1, comprising a support surface having at least one cutting line and a cutting device (25) movable along said cutting line over the support surface, characterized in that the support surface is formed by a section of a lateral surface (44) of a roll (22) while the cutting device (25) can be moved over the lateral surface (44) along a cutting line which follows a generating line of the lateral surface (44), and the roll (22) is mounted, so as to be rotatable about an axle (21) parallel to the axial direction of the paper reel (8), in a holder which is displaceable in a displacement direction transverse to said axial direction, so that the axle (21) is freely displaceable to a limited extent transverse to the axial direction and to the displacement direction.

8. Apparatus according to claim 7, characterized in that the holder is formed by a carriage (11) displaceable in the displacement direction, and the axle (21) is mounted so as to be rotatable and nondisplaceable in a slide (17) which is mounted so as to be displaceable transversely to the axle (21) and transversely to the displacement direction of the carriage (11) in the latter.

9. Apparatus according to claim 8, characterized in that the carriage (11) is mounted so as to be displaceable in a frame which is displaceable transversely to the axle (21) and to the displacement direction.

10. Apparatus according to claim 8, characterized in that the cutting device (25) can be moved in the slide (17) parallel to the axle (21).

11. Apparatus according to claim 10, characterized in that the cutting device (25) can be fed towards the roll (22).

12. Apparatus according to claim 10, characterized in that the cutting device (25) is arranged, so as to be displaceable towards the axle (21) and withdrawable therefrom but nondisplaceable transverse thereto, on a transverse slide (23) which can be moved-parallel to the axle (21) in the slide (17) and which also carries an adhesive device (26).

13. Apparatus according to claim 12, characterized in that the adhesive device (26) is arranged on the transverse slide (23) so as to be displaceable transversely to the axle (21) and to the displacement direction.

14. Apparatus according to claim 7, characterized in that the axial direction of the paper reel (8) is horizontal and the holder is displaceable horizontally above said reel, in such a way that the end positions of the axle (21) are on different sides of the uppermost generating line of the paper reel (8).

15. Apparatus according to claim 14, characterized in that the axle (21) is vertically displaceable in the holder.

16. Apparatus according to claim 7, characterized in that the roll (22) has at least one cutting bar (45, 47) following a generating line, sunk into the support surface and preferably having a plastics surface, over which the cutting line runs.

17. Apparatus according to claim 16, characterized in that it has at least two such cutting bars (45, 47).

18. Apparatus according to claim 7, characterized in that the roll (22) has at least one suction zone substantially extending over the width of the support surface and provided with suction orifices.

19. Apparatus according to claim 7, characterized in that the lateral surface (44) substantially corresponds to a lateral surface sector of a cylinder whose axis coincides with the axis (21) of the roll (22).

20. Apparatus according to claim 7, characterized in that it has a take-off device (27) for removing the end section, which device comprises a plurality of revolving belts (29) which are distributed over the length of the roll (22) and can be pressed against the lateral surface (44).

* * * * *